US009630769B2

(12) United States Patent
Schultz

(10) Patent No.: US 9,630,769 B2
(45) Date of Patent: Apr. 25, 2017

(54) STRINGED SEASONAL LIGHT STORAGE DEVICE

(71) Applicant: Larry Schultz, Saugus, CA (US)

(72) Inventor: Larry Schultz, Saugus, CA (US)

( * ) Notice: Subject to any disclaimer, the term of this patent is extended or adjusted under 35 U.S.C. 154(b) by 54 days.

(21) Appl. No.: 14/670,458

(22) Filed: Mar. 27, 2015

(65) Prior Publication Data

US 2016/0280452 A1 Sep. 29, 2016

(51) Int. Cl.

| | |
|---|---|
| ***F21S 8/00*** | (2006.01) |
| ***B65D 85/42*** | (2006.01) |
| ***B65D 43/16*** | (2006.01) |
| ***B65D 25/10*** | (2006.01) |
| ***F21S 4/10*** | (2016.01) |
| *F21W 121/00* | (2006.01) |
| *F21V 29/83* | (2015.01) |

(52) U.S. Cl.

CPC ..... *B65D 85/42* (2013.01); *B65D 25/10* (2013.01); *B65D 43/16* (2013.01); *F21S 4/10* (2016.01); *F21V 29/83* (2015.01); *F21W 2121/004* (2013.01)

(58) Field of Classification Search

USPC ..... 206/419; 362/364, 382, 219

See application file for complete search history.

(56) References Cited

U.S. PATENT DOCUMENTS 1,719,715 A * 7/1929 Monk ..... F21S 4/28 362/382
2,816,216 A * 12/1957 Dasher ..... F21S 8/02 362/364
3,204,090 A * 8/1965 Kvarda, Jr. ..... F21S 4/20 362/249.01
3,539,795 A * 11/1970 Hawley ..... F21V 17/00 362/263
3,569,691 A * 3/1971 Tracy ..... F21S 2/00 362/233
3,692,993 A * 9/1972 Robinson ..... F21S 8/028 362/249.07
4,128,863 A 12/1978 Premetz
4,546,419 A * 10/1985 Johnson ..... F21S 8/02 200/310
5,404,279 A 4/1995 Wood
5,510,966 A 4/1996 Konecny
5,594,628 A * 1/1997 Reuter ..... F21V 15/01 362/152
5,816,687 A * 10/1998 Tapp ..... F21V 17/107 362/248

(Continued)

*Primary Examiner* — J. Gregory Pickett
*Assistant Examiner* — Gideon Weinerth

(57) ABSTRACT

A stringed seasonal light storage device allows stringed seasonal lights to be maintained on a structure and alternatively positioned to be displayed extending from a housing or obscured by positioning within the housing. The device includes a base having a rear face, a pair of sidewalls and an open bottom. Each of a pair of laterally aligned slots extends the sidewalls to receive a light string therein positioning a light between the sidewalls and pivotable between a display position and a storage position. A cover coupled to the base is pivotable between an open position and a closed position to permit moving of the light between the display position and the storage position and inhibit movement of the light between the storage position and the display position when the cover is in the closed position.

9 Claims, 6 Drawing Sheets

(56) References Cited

U.S. PATENT DOCUMENTS 6,019,488 A * 2/2000 Hastings ..... F21V 15/01 362/152
6,050,709 A * 4/2000 Hastings ..... F21V 17/007 362/145
6,088,967 A 7/2000 Johnson
6,135,618 A * 10/2000 Tai ..... F21S 8/033 220/3.7
6,224,232 B1 5/2001 Rodriguez
6,259,025 B1 * 7/2001 Tai ..... F21S 8/033 174/66
6,309,086 B1 10/2001 Tomlinson
6,363,662 B1 * 4/2002 Coates ..... E04D 13/076 362/147
6,474,850 B1 11/2002 Burton
6,572,239 B1 * 6/2003 Harbin ..... F21V 15/01 362/145
6,843,583 B2 * 1/2005 Winter ..... F21V 17/007 362/151
6,918,680 B2 7/2005 Seeberger
7,824,046 B2 * 11/2010 Martinez ..... F21L 4/08 362/147
8,002,433 B1 * 8/2011 Cucksey ..... F21V 21/30 362/217.01
8,136,962 B2 3/2012 Marlonia
8,317,353 B1 * 11/2012 Martin ..... F21S 4/10 248/339
8,926,118 B1 * 1/2015 Whittaker ..... F21S 4/10 362/145
D723,196 S * 2/2015 Rose ..... D26/25
2002/0085380 A1 * 7/2002 Padermos ..... F21V 15/01 362/145
2003/0076678 A1 * 4/2003 Diaco ..... F21V 21/088 362/249.03
2003/0235053 A1 * 12/2003 Jones ..... F21V 17/007 362/396
2004/0105255 A1 * 6/2004 Seeburger ..... E04D 13/158 362/145
2005/0243565 A1 11/2005 Witherspoon
2009/0010012 A1 * 1/2009 George ..... F21V 21/096 362/398
2009/0185370 A1 * 7/2009 Moore ..... F21V 21/088 362/219
2010/0232151 A1 * 9/2010 Jones ..... F21V 17/007 362/217.15
2011/0090676 A1 * 4/2011 Sortor ..... F21V 17/16 362/145
2011/0164409 A1 * 7/2011 Smith ..... F21V 21/00 362/145
2012/0069587 A1 * 3/2012 Holland ..... F21S 4/10 362/396
2016/0153644 A1 * 6/2016 Russikoff ..... F21S 4/10 362/396

* cited by examiner

STRINGED SEASONAL LIGHT STORAGE DEVICE

BACKGROUND OF THE DISCLOSURE

Field of the Disclosure

The disclosure relates to light storage devices and more particularly pertains to a new light storage device for allowing stringed seasonal lights to be maintained on a structure throughout the year and alternatively positioned to be displayed extending from a housing or obscured by positioning within the housing.

SUMMARY OF THE DISCLOSURE

An embodiment of the disclosure meets the needs presented above by generally comprising a base having a rear face, a pair of sidewalls and an open bottom. Each of a pair of laterally aligned slots extends the sidewalls to receive a light string therein positioning a light between the sidewalls and pivotable between a display position and a storage position. A cover coupled to the base is pivotable between an open position and a closed position to permit moving of the light between the display position and the storage position and inhibit movement of the light between the storage position and the display position when the cover is in the closed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
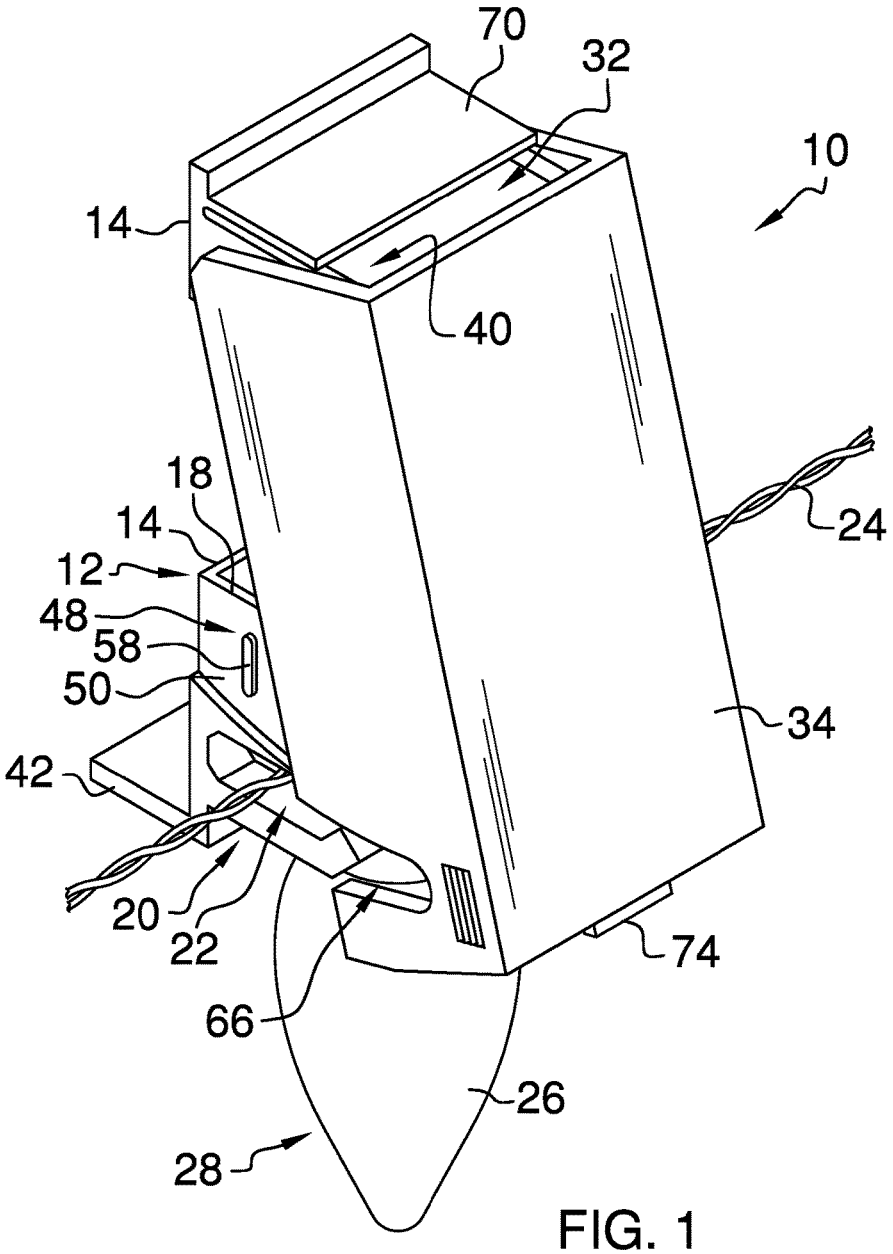
FIG. 1 is a top front side perspective view of a stringed seasonal light storage device according to an embodiment of the disclosure.
Figure 2:
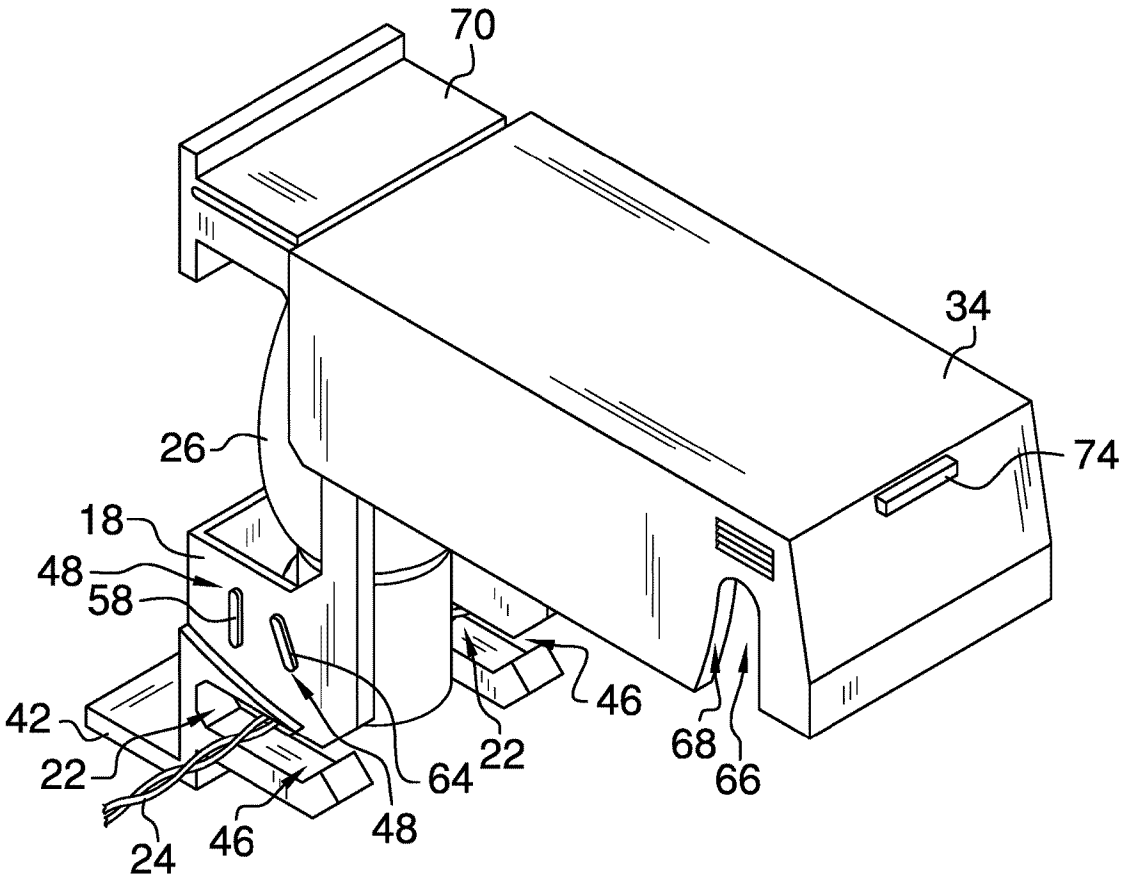
FIG. 2 is a top front side perspective view of an embodiment of the disclosure in an open position with a seasonal light in a stored position.
Figure 4:
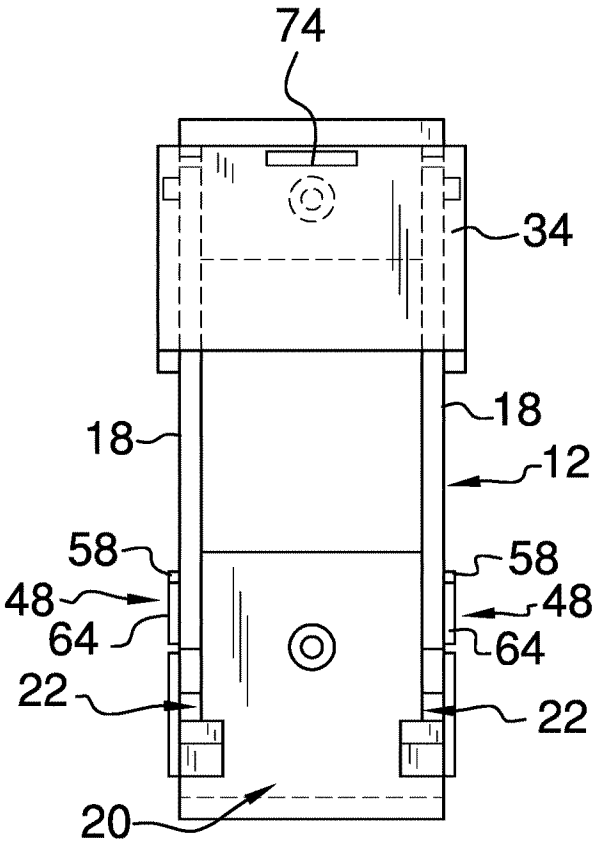
FIG. 4 is a front view of an embodiment of the disclosure in the open position.
Figure 3:
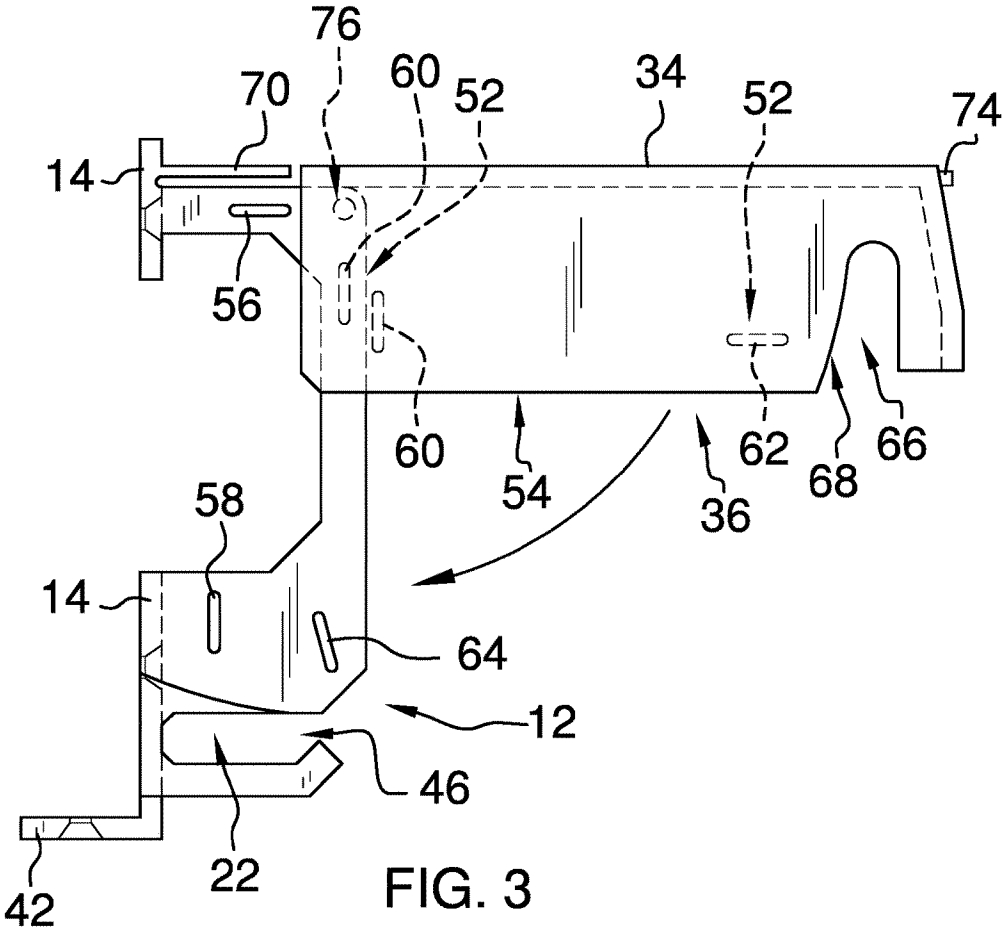
FIG. 3 is a side view of an embodiment of the disclosure in the open position.
Figure 5:
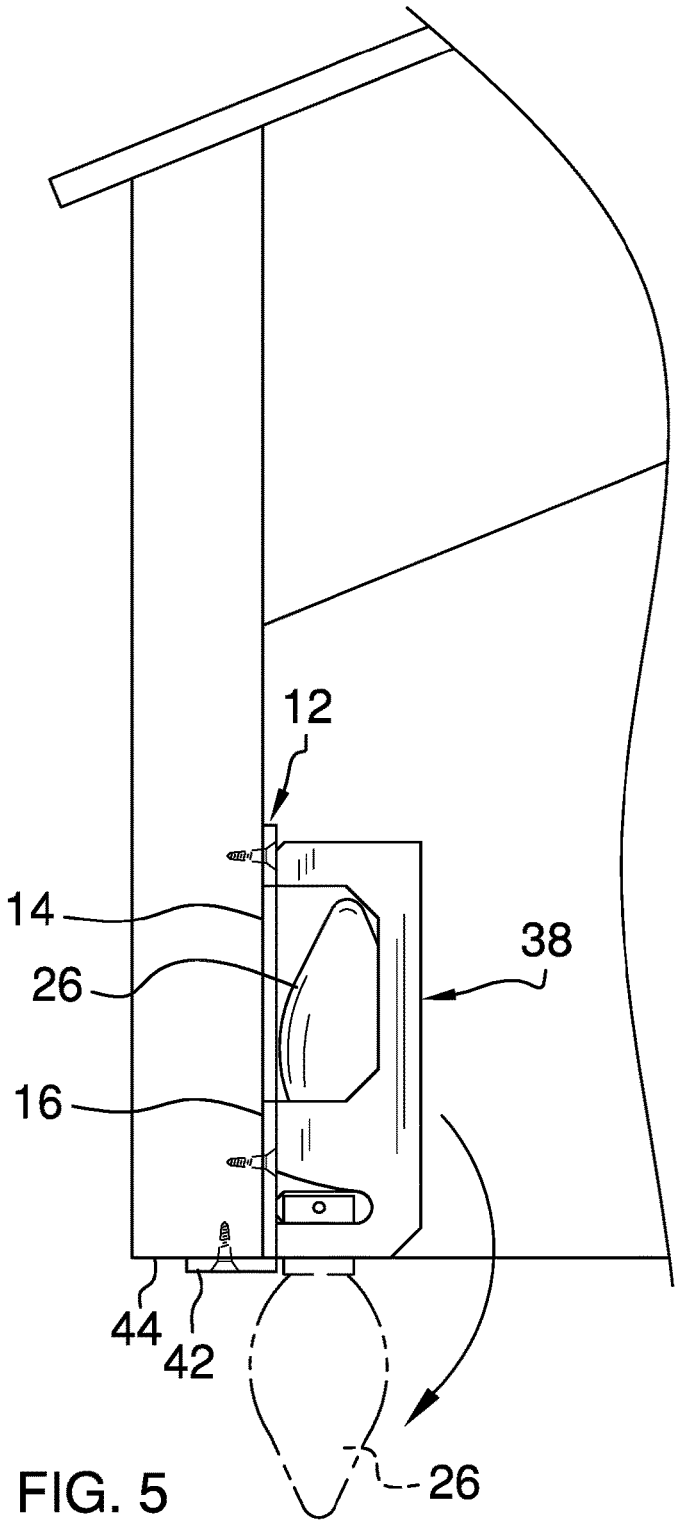
FIG. 5 is a side view of an embodiment of the disclosure in use installed on a fascia board.

With reference now to the drawings, and in particular to FIGS. 1 through 7 thereof, a new light storage device embodying the principles and concepts of an embodiment of the disclosure and generally designated by the reference numeral 10 will be described.

As best illustrated in FIGS. 1 through 7, the stringed seasonal light storage device 10 generally comprises a base 12 having a rear face 14. The rear face 14 is planar and apertured to receive a conventional fastener therethrough wherein the base 12 is configured for coupling to a surface 16 which may typically be a back face of a fascia board on a building. The base 12 has a pair of sidewalls 18 and an open bottom 20. The base 12 is structured to include a pair of slots 22. Each of the slots 22 extends into an associated one of the sidewalls 18 such that the slots 22 are laterally aligned and configured to receive a light string 24 therein such that a light 26 on the light string 24 is positioned in alignment with the base 12. The light 26 pivotable between a display position 28 extending through the open bottom 20 of the base 12 and a storage position 30 extending upwardly away from the open bottom 20 of the base 12. A distal portion 46 of each slot 22 relative to the rear face 14 is angled upwardly extending away from the rear face 14 facilitating retention of the light string 24 within the slots 22.

A cover 34 is pivotally coupled to the base 12. The cover 34 is pivotable between an open position 36 and a closed position 38 wherein the cover 34 is configured to permit moving of the light 26 between the display position 28 and the storage position 30 while the cover 34 is in the open position 36 and inhibit movement of the light 26 between the storage position 30 and the display position 28 when the cover 34 is in the closed position 38. A top face 32 of the base 12 is open. The cover 34 has an open face 40 positioned adjacent to the top face 32 of the base 12.

A flange 42 is coupled to and extends from the base 12. The flange 42 extends away from the rear face 14 such that the flange 42 defines a right angle with the rear face 14 of the base 12. The flange 42 is apertured for receiving a conventional fastener therethrough. Thusly, the base 12 is configured for coupling to the surface 16 aligned with a bottom edge 44 of the surface 16 wherein the light 26 will protrude downwardly relative to the bottom edge 44 when the light 26 is in the display position 28.

Each of a plurality of base tabs 48 extends from an outer face 50 of an associated one of the sidewalls 18 of the base 12. Each of a plurality of cover tabs 52 extends from an inwardly directed surface 54 of the cover 34. Each of the base tabs 48 is positioned complementary to an associated one of the cover tabs 52 wherein each cover tabs 52 is positionable to engage the associated one of the base tabs 48 to hold the cover 34 in a static position relative to the base 12. The base tabs 48 include an upper base tab 56 and a first lower base tab 58 proximate to the rear face 14 of the base 12. The upper base tab 56 is engaged by an upper cover tab 60 and the first lower base tab 58 is engaged by a lower cover tab 62 when the cover 34 is in the closed position 38. A second lower base tab 64 is engaged by the lower cover tab 62 propping the cover 34 into a partially open position facilitating manipulation of the light 26 and light string 24 when moving between the display position 28 and the storage position 30.

Each of a pair of slits 66 extends into the cover 34. The slits 66 align with the slots 22 when the cover 34 is in the closed position 38. The slits 66 have curved sections 68 to prevent pinching of the light string 24 as the cover 34 is pivoted into the closed position 38.

Figure 6:
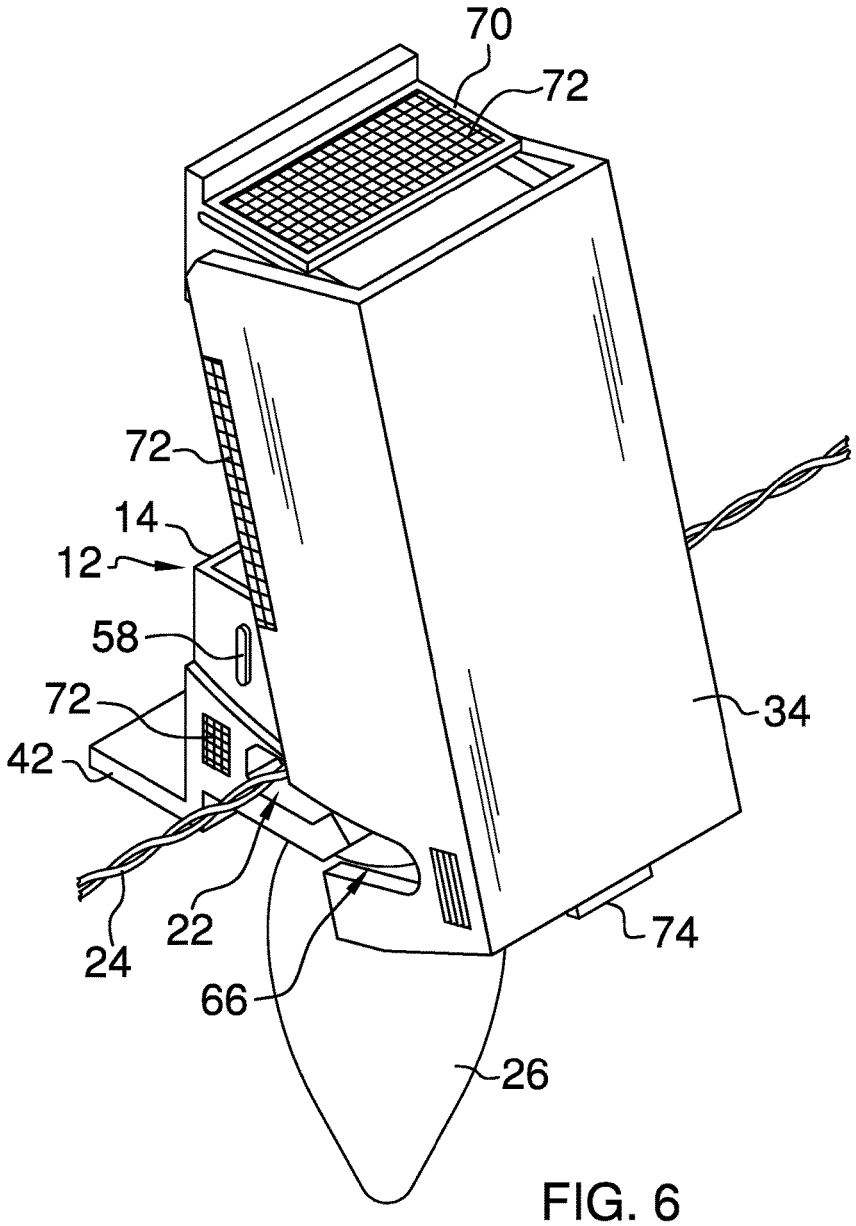
FIG. 6 is a top front side perspective view of an embodiment of the disclosure.
Figure 7:
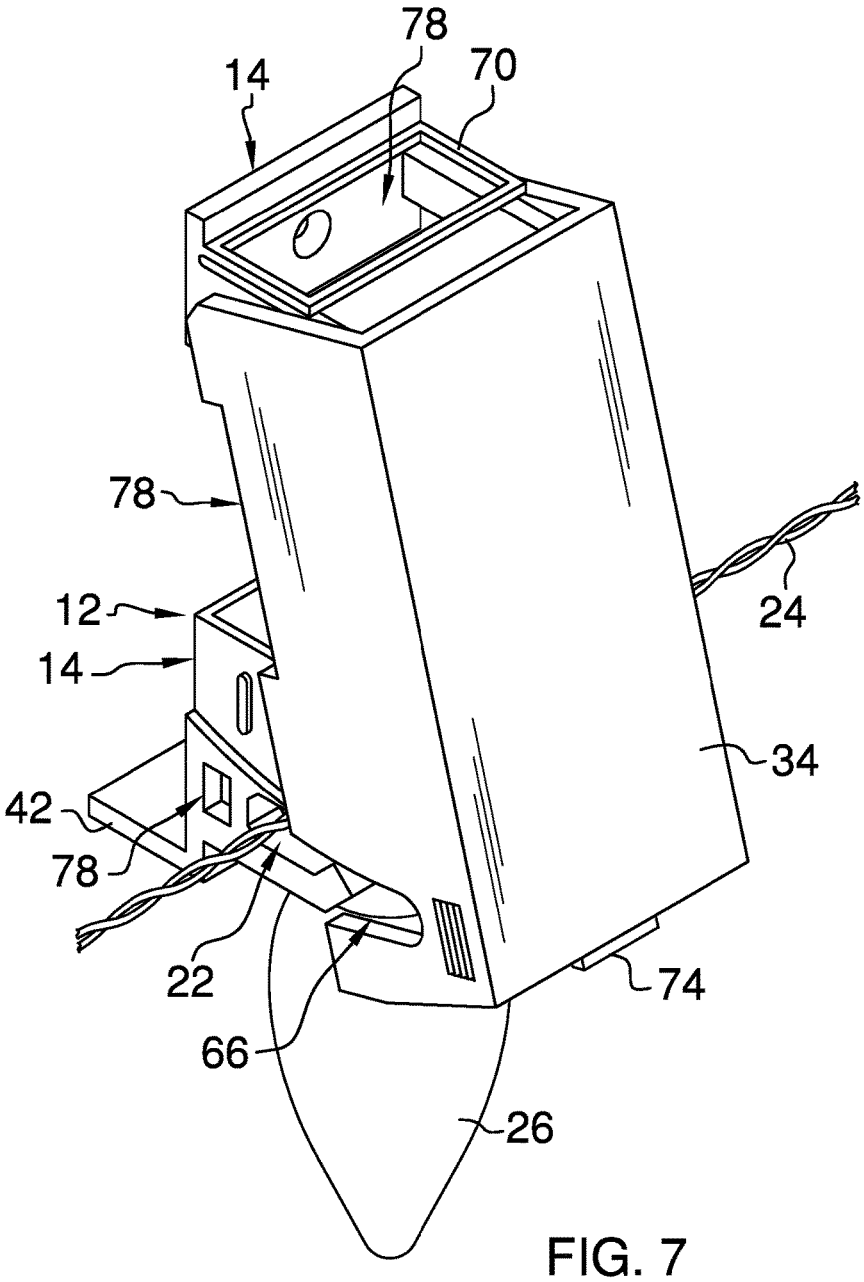
FIG. 7 is a top front side perspective view of an embodiment of the disclosure.

A cover stop 70 is coupled to and extends over the top face 32 of the base 12. The cover stop 70 abuts by the cover 34 when the cover 34 is pivoted into the open position 36 wherein the cover stop 70 inhibits pivoting of the cover 34 beyond the fully open position 36. As shown in FIG. 6, vents 72 may be provided in the sidewalls 18, cover stop 70, and the cover 34 to further promote cooling and air flow around the light 26. In an embodiment shown in FIG. 7, the cover stop 70, base 12, and cover 34 may be open in the positioning of the vents 72 in FIG. 6, to further facilitate air flow through the device 10 to prevent heat buildup from the light 26 if deemed necessary.

A projection 74 extends from the cover 34. The projection 74 extends outwardly away from a pivot point 76 of the cover 34 relative to the base 12 wherein the projection 74 is configured to facilitate opening of the cover 34.

In use, the base 12 is installed onto the surface 16. The light string 24 is positioned to extend through the slots 22 with the light 26 being positioned between the sidewalls 18 of the base 12. Multiple devices 10 are used such that each light 26 on the light string 24 is housed within a respective base 12. When display is desired, the light 26 is positioned in the display position 28 extending through the open bottom 20 of the base 12. The cover 34 secures the light 26 relative to the base 12. When the lights 26 are no longer to be displayed, each cover 34 is opened and the respective lights 26 are manipulated into the storage position 30 while the cover 34 is in the open position 36. The cover 34 is then moved back to the closed position 38 to secure the light 26 within the base 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A stringed seasonal light storage device comprising:

a base having a rear face, said rear face being planar wherein said base is configured for coupling to a surface, said base having a pair of sidewalls and an open bottom, said base being structured to include a pair of slots, each of said slots extending into an associated one of said sidewalls such that said slots are laterally aligned and configured to receive a light string therein such that a light on the light string is positioned in alignment with the base and pivotable between a display position extending through said open bottom of said base and a storage position extending upwardly away from the open bottom of the base, a distal portion of each said slot relative to said rear face being angled upwardly extending away from said rear face; and a cover pivotally coupled to said base, said cover being pivotable between an open position and a closed position wherein said cover is configured to permit moving of the light between the display position and the storage position while said cover is in the open position and inhibit movement of the light between the storage position and the display position when said cover is in said closed position.

2. The device of claim 1, further comprising a flange coupled to and extending from said base, said flange extending away from said rear face such that said flange defines a right angle with said rear face of said base wherein said base is configured for coupling to the surface aligned with a bottom edge of the surface.

3. The device of claim 1, further comprising:

a plurality of base tabs, each of said base tabs extending from an outer face of an associated one of said sidewalls of said base; and a plurality of cover tabs, each of said cover tabs extending from an inwardly directed surface of said cover, each of said base tabs being positioned complementary to an associated one of said cover tabs wherein each said cover tabs is positionable to engage said associated one of said base tabs to hold said cover in a static position relative to said base.

4. A stringed seasonal light storage device comprising:

a base having a rear face, said rear face being planar wherein said base is configured for coupling to a surface, said base having a pair of sidewalls and an open bottom, said base being structured to include a pair of slots, each of said slots extending into an associated one of said sidewalls such that said slots are laterally aligned and configured to receive a light string therein such that a light on the light string is positioned in alignment with the base and pivotable between a display position extending through said open bottom of said base and a storage position extending upwardly away from the open bottom of the base;

a cover pivotally coupled to said base, said cover being pivotable between an open position and a closed position wherein said cover is configured to permit moving of the light between the display position and the storage position while said cover is in the open position and inhibit movement of the light between the storage position and the display position when said cover is in said closed position; and a pair of slits extending into said cover, said slits aligning with said slots when said cover is in said closed position.

5. The device of claim 1, further comprising said cover having an open face positioned adjacent to a top face of said base, and said top face of said base being open.

6. The device of claim 1, further comprising a cover stop coupled to and extending over a top face of said base, said cover stop being abutting by said cover when said cover is pivoted into a fully open position wherein said cover stop inhibits pivoting of said cover beyond said fully open position.

7. The device of claim 6, further comprising said cover stop being vented.

8. The device of claim 1, further comprising a projection extending from said cover, said projection extending outwardly away from a pivot point of said cover relative to said base wherein said projection is configured to facilitate opening of said cover.

9. A stringed seasonal light storage device comprising:

a base having a rear face, said rear face being planar wherein said base is configured for coupling to a surface, said base having a pair of sidewalls and an open bottom, said base being structured to include a pair of slots, each of said slots extending into an associated one of said sidewalls such that said slots are laterally aligned and configured to receive a light string therein such that a light on the light string is positioned in alignment with the base and pivotable between a display position extending through said open bottom of said base and a storage position extending upwardly away from the open bottom of the base, a top face of said base being open;

a cover pivotally coupled to said base, said cover being pivotable between an open position and a closed position wherein said cover is configured to permit moving of the light between the display position and the storage position while said cover is in the open position and inhibit movement of the light between the storage position and the display position when said cover is in said closed position, said cover having an open face positioned adjacent to said top face of said base;

a flange coupled to and extending from said base, said flange extending away from said rear face such that said flange defines a right angle with said rear face of said base wherein said base is configured for coupling to the surface aligned with a bottom edge of the surface;

a distal portion of each said slot relative to said rear face being angled upwardly extending away from said rear face;

a plurality of base tabs, each of said base tabs extending from an outer face of an associated one of said sidewalls of said base;

a plurality of cover tabs, each of said cover tabs extending from an inwardly directed surface of said cover, each of said base tabs being positioned complementary to an associated one of said cover tabs wherein each said cover tabs is positionable to engage said associated one of said base tabs to hold said cover in a static position relative to said base;

a pair of slits extending into said cover, said slits aligning with said slots when said cover is in said closed position;

a cover stop coupled to and extending over a top face of said base, said cover stop being abutting by said cover when said cover is pivoted into a fully open position wherein said cover stop inhibits pivoting of said cover beyond said fully open position, said cover stop being vented; and a projection extending from said cover, said projection extending outwardly away from a pivot point of said cover relative to said base wherein said projection is configured to facilitate opening of said cover.

* * * * *